US006523605B2

(12) United States Patent
Doko et al.

(10) Patent No.: US 6,523,605 B2
(45) Date of Patent: Feb. 25, 2003

(54) HEAT EXCHANGER MADE OF AN ALUMINUM ALLOY

(75) Inventors: Takeyoshi Doko, Tokyo (JP); Koji Okada, Tokyo (JP); Takeshi Iguchi, Kariya (JP); Takaaki Sakane, Kariya (JP); Yoshihiro Kinoshita, Kariya (JP); Taketoshi Toyama, Kariya (JP); Akira Uchikawa, Kariya (JP); Satoshi Nohira, Kariya (JP); Homare Koutate, Kariya (JP)

(73) Assignees: The Furukawa Electric Co., Ltd., Tokyo (JP); Denso Corporation, Aichi-ken (JP)

( * ) Notice: Subject to any disclaimer, the term of this patent is extended or adjusted under 35 U.S.C. 154(b) by 0 days.

(21) Appl. No.: 09/802,907

(22) Filed: Mar. 12, 2001

(65) Prior Publication Data

US 2001/0013407 A1 Aug. 16, 2001

Related U.S. Application Data

(63) Continuation of application No. 08/983,030, filed as application No. PCT/JP97/01491 on Apr. 30, 1997.

(30) Foreign Application Priority Data

May 2, 1996 (JP) ..... 8-111546

(51) Int. Cl.[7] ..... F28F 13/18

(52) U.S. Cl. ..... 165/133; 165/916; 165/175; 228/226; 228/183

(58) Field of Search ..... 165/133, 134.1, 165/136, 153, 175, 916; 228/183, 225, 226

(56) References Cited

U.S. PATENT DOCUMENTS

| | | | |
|---|---|---|---|
| 4,991,647 | A | 2/1991 | Kawabe et al. |
| 5,067,561 | A | 11/1991 | Joshi et al. |
| 5,113,930 | A | 5/1992 | Le Gauyer |
| 5,121,790 | A | 6/1992 | Persson |
| 5,125,452 | A | 6/1992 | Yamauchi et al. |

(List continued on next page.)

FOREIGN PATENT DOCUMENTS

| | | |
|---|---|---|
| EP | 0637481 | 2/1995 |
| JP | 59215909 | 12/1984 |

(List continued on next page.)

*Primary Examiner*—Christopher Atkinson
(74) *Attorney, Agent, or Firm*—Birch, Stewart, Kolasch & Birch, LLP

(57) ABSTRACT

There is disclosed a heat exchanger made of an aluminum alloy having a radiator part (10) and an oil cooler part (11) in combination and manufactured integrally by the brazing method, wherein a refrigerant tank (13) for covering and sealing the oil cooler part is made of an aluminum alloy, an aluminum alloy containing Si in an amount from more than 7.0 wt % to 12.0 wt %, Fe in an amount from more than 0.05 wt % to 0.5 wt %, Cu in an amount from more than 0.4 wt % to 8.0 wt %, Zn in an amount from more than 0.5 wt % to 10.0 wt %, and the balance of aluminum and inevitable impurities is used as a filler material of brazing sheets that are used for the oil cooler part and are brazed in the tank, and the refrigerant tank is assembled integrally with the radiator part and the oil cooler part by brazing with the brazing material. The heat exchanger made of an aluminum alloy by using an aluminum material instead of a resin tank, can be easily recycled, is excellent in corrosion resistance, and can be manufactured without requiring a step of caulking a tank.

8 Claims, 3 Drawing Sheets

U.S. PATENT DOCUMENTS

| | | | |
|---|---|---|---|
| 5,152,339 | A | 10/1992 | Calleson |
| 5,260,142 | A | 11/1993 | Kawabe et al. |
| 5,292,595 | A | 3/1994 | Yamauchi et al. |
| 5,422,191 | A | 6/1995 | Childree |
| 5,605,191 | A | 2/1997 | Eto et al. |
| 5,676,203 | A | 10/1997 | Kajikawa et al. |
| 5,732,767 | A | 3/1998 | Saperstein |
| 5,762,132 | A | 6/1998 | Evans et al. |
| 5,863,669 | A | 1/1999 | Miller |

FOREIGN PATENT DOCUMENTS

| | | |
|---|---|---|
| JP | 63-5288 | 1/1988 |
| JP | 2301616 | 12/1990 |
| JP | 4254195 | 9/1992 |
| JP | 630688 | 4/1994 |
| JP | 630689 | 4/1994 |
| JP | 406185331 | 7/1994 |
| JP | 790442 | 4/1995 |
| KR | A936426 | 9/1991 |

PRIOR ART

PRIOR ART

HEAT EXCHANGER MADE OF AN ALUMINUM ALLOY

This application is a continuation of co-pending application Ser. No. 08/983,030, filed on Mar. 2, 1998 and for which priority is claimed under 35 U.S.C. § 120. Application Ser. No. 08/983,030 is the national phase of PCT International Application No. PCT/JP97/01491 filed on Apr. 30, 1997 under 35 U.S.C. § 371. The entire contents of each of the above-identified applications are hereby incorporated by reference. This application also claims priority of Application No. 8-111546 filed in Japan on May 2, 1996 under 35 U.S.C. § 119.

TECHNICAL FIELD

The present invention relates to a heat exchanger made of an aluminum alloy, and more particularly to a heat exchanger with a radiator and an oil cooler integrated that is produced by using aluminum alloy brazing sheets.

BACKGROUND ART

A heat exchanger having a radiator and an oil cooler in combination is manufactured by assembling a radiator core part (10) and an oil cooler part (11) (oil passages (7) formed by joining brazing sheets (8) are illustrated in a simplified manner in the drawings) and then mechanically associating them with tanks (6), for example, as shown perspectively in FIG. 4.

Herein, as is apparent from FIG. 5 showing a perspective view, the radiator is made up of the radiator core part (10), comprising flat tubes (3), thin fins (1), side supports (12), and headers (4), and the tanks (6). Each of the corrugated thin fins (1) is formed between the flat tubes (3), with the corrugated thin fin integrated with the flat tubes, and the ends of the flat tubes (3) are open to space (2) formed by the headers (4) and the tanks (6), so that a high-temperature refrigerant is passed from the space in one tank through the flat tubes (3) to another space (2) of the other tank (6), to recirculate the refrigerant, whose temperature has been lowered due to the heat exchange at the tubes (3) and the fins (1).

The radiator part is assembled as follows: as the tube material and the header material, brazing sheets are used, wherein the core material is, for example, JIS 3003 alloy; the inner side on the core material, that is, the side to which the refrigerant constantly contacts is coated with JIS 7072 alloy as a lining material; and the outer side on the core material is clad with a usual filler material, such as JIS 4045; and the tubes and the headers are integrated with corrugated fins and other members by brazing.

In the oil cooler part (11), the oil passages (7) formed by joining the brazing sheets (8) extend through the space in the tank (2), and an oil having a high temperature passing through the passages (7) is cooled with the refrigerant passing through the space (2). For forming the oil passages, brazing sheets are used, wherein, as the core material, for example, JIS 3003 alloy is used; the outer side on the core material, that is, the side to which the refrigerant constantly contacts is clad, for example, with JIS 7072 alloy, and the inner side on the core material is clad, usually, with a filler material, such as JIS 4045. Generally the brazing sheets are brazed by heating them to a temperature of about 600° C.

Thus, the radiator part and the oil cooler part are assembled by brazing at a temperature of about 600° C. The brazing is carried out, for example, by the flux brazing method or the non-corrosive flux brazing method, wherein a non-corrosive flux is used.

However, conventionally the tank (6) is generally made of a resin material, and the tank (6) has to be attached in a step separated from the step of assembling the radiator part and the oil cooler part by brazing, so that there is a difficulty that additional step is required. Further, in such a heat exchanger, the part between the resin tank (6) and the header (4) that is fastened, is required to be caulked through a resin packing (5) or the like, which leads to a defect that crevice corrosion is apt to take place at the boundary between the resin packing (5) and the header (4).

Further, in recent years, recycling of material has attracted attention in view of effective use of resources on the earth. Heat exchangers for automobiles are removed when the automobiles are disassembled, and they are melted as aluminum alloys for recycling. However, as shown in FIG. 4, when the heat exchanger has, as the tank (6), a tank made of resin, the resin tank has to be removed purposely when the automobile is disassembled, and that becomes a bottleneck in the recycling process.

Therefore, it is desirable that the tank also be made of an aluminum alloy and be assembled simultaneously by the brazing technique. However, after that brazing, the oil cooler part is brazed with it covered with the tank. Therefore, if the brazing of the oil cooler is incomplete, it cannot be repaired anymore. Thus, it is required that the brazing be effected completely, but it is conventionally difficult due to the following reason. Since the oil cooler part is covered with the tank, the temperature of the brazing is not elevated satisfactorily, and defective brazing is apt to occur. Further, if the heating is carried out to elevate the temperature satisfactorily so as not to cause defective brazing, the brazing temperature is elevated excessively for the radiator part, and thus inconveniently the filler material diffuses into the radiator tubes and the fins. Further, in the oil cooler, since the brazed part is in contact with a refrigerant, local corrosion is apt to occur due to the potential difference between the brazed part and the core material part. This problem cannot be solved by brazing by the conventional brazing technique.

Therefore, an object of the present invention is to provide a heat exchanger that is made of an aluminum alloy by using an aluminum material instead of a resin tank, can be easily recycled, is excellent in corrosion resistance, and can be produced without requiring a step of caulking a tank.

Other and further objects, features, and advantages of the invention will appear more fully from the following description, taken in connection with the accompanying drawings.

DISCLOSURE OF INVENTION

The above object has been attained by providing a heat exchanger made of an aluminum alloy having the following constitution.

According to the present invention there are provided;

(1) A heat exchanger made of an aluminum alloy having a radiator part and an oil cooler part in combination and assembled integrally by the brazing method, wherein a refrigerant tank for covering and sealing said oil cooler part is made of an aluminum alloy, an aluminum alloy containing Si in an amount from more than 7.0 wt % to 12.0 wt %, Fe in an amount from more than 0.05 wt % to 0.5 wt %, Cu in an amount from more than 0.4 wt % to 8.0 wt %, Zn in an amount from more than 0.5 wt % to 10.0 wt %, and the balance of aluminum and inevitable impurities is used as a filler material of brazing sheets that are used for said oil cooler part and are brazed in said tank, and said refrigerant tank is assembled integrally with said radiator part and said oil cooler part by brazing with said brazing material; and (2) A heat exchanger made of an aluminum alloy having a radiator part and an oil cooler part in combination and assembled integrally by the brazing method, wherein a refrigerant tank for covering and sealing said oil cooler part is made of an aluminum alloy, an aluminum alloy containing Si in an amount from more than 7.0 wt % to 12.0 wt %, Fe in an amount from more than 0.05 wt % to 0.5 wt %, Cu in an amount from more than 0.4 wt % to 8.0 wt %, Zn in an amount from more than 0.5 wt % to 10.0 wt %, one or both of In in an amount from more than 0.002 wt % to 0.3 wt % and Sn in an amount from more than 0.002 wt % to 0.3 wt %, and the balance of aluminum and inevitable impurities is used as a filler material of brazing sheets that are used for said oil cooler part and are brazed in said tank, and said refrigerant tank is assembled integrally with said radiator part and said oil cooler part by brazing with said brazing material.

In this invention, the radiator part and the oil cooler part can be assembled integrally in one step brazing.

BEST MODE FOR CARRYING OUT THE INVENTION

Figure 1:
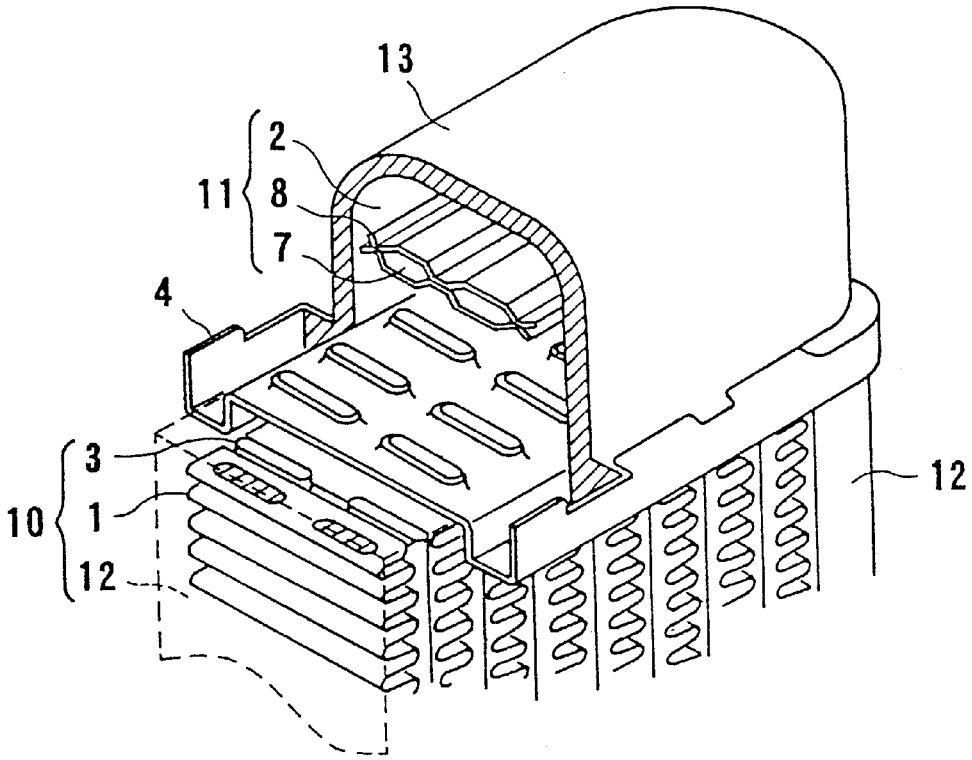
FIG. 1 is a perspective view, partly in cross section, of an embodiment of the heat exchanger of the present invention with a radiator and an oil cooler integrated.

Now, the present invention is described in detail referring to the drawing.

Figure 4:
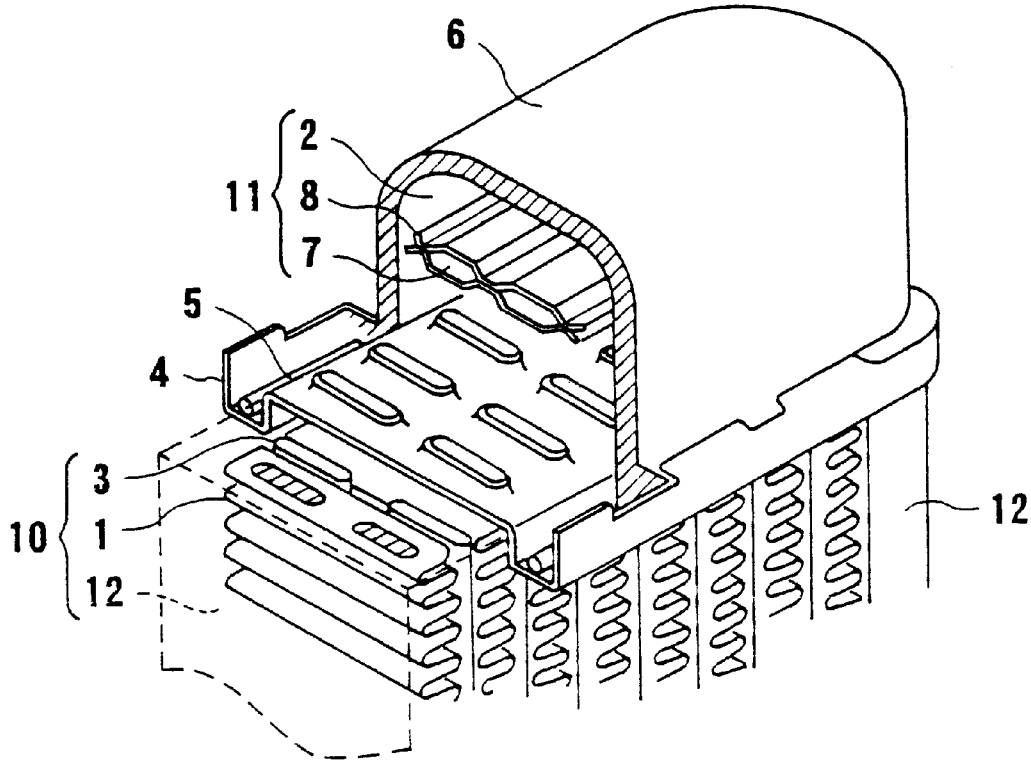
FIG. 4 is a perspective view of a conventional heat exchanger having a radiator and an oil cooler in combination.
Figure 5:
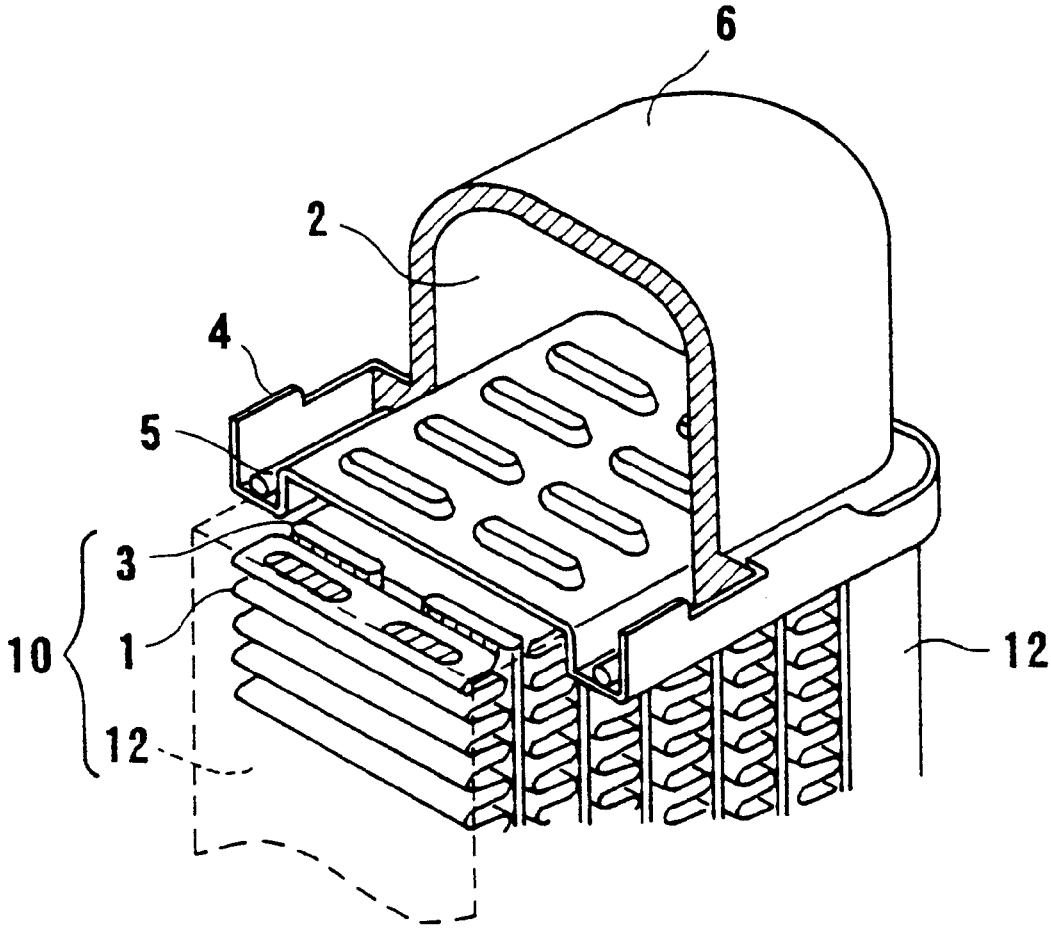
FIG. 5 is a perspective view of the conventional radiator.

FIG. 1 is an embodiment of a heat exchanger of the present invention made of an aluminum alloy with a radiator and an oil cooler integrated by brazing (a double pipe-type, brazing-type heat exchanger), wherein instead of a resin tank (6) shown in FIG. 4, a tank (13) in which brazing sheets of an aluminum alloy are used is employed, and a header (4) of a radiator core part and the tank (13) are assembled by one step by brazing-heating. Accordingly a packing (5) as used in the prior art is not required. In the present invention, since the tank is made of an aluminum alloy and its joining is made by the brazing method, crevice corrosion between the tank and the header does not occur, and when the exchanger is recovered as waste refuse, the tank can also be recycled as an aluminum material without dismounting it. Further, since the header and the tank are integrated by one step of brazing, a step of caulking the tank is not required. In passing, in FIG. 1, the same reference numerals are used to indicate the corresponding parts of FIG. 4.

The present invention is directed to the thus integral heat exchanger and as the brazing alloy of the brazing sheets (e.g., the above brazing sheets (8) in FIG. 1) used for the oil cooler, an aluminum alloy containing Si in an amount from more than 7.0 wt % to 12.0 wt %, Fe in an amount from more than 0.05 wt % to 0.5 wt %, Cu in an amount from more than 0.4 wt % to 8.0 wt %, Zn in an amount from more than 0.5 wt % to 10.0 wt %, and the balance of aluminum and inevitable impurities, additionally plus one or both of In in an amount from more than 0.002 wt % to 0.3 wt % and Sn in an amount from more than 0.002 wt % to 0.3 wt % for low-temperature brazing, is used. This aluminum alloy is an alloy suggested as a low-temperature brazing alloy, for example, in JP-A ("JP-A" means unexamined published Japanese patent application) No. 90442/1995. The reason why brazing sheets clad with the brazing alloy having the above specified composition are used in the present production method is described below.

In the above brazing alloy, Si lowers the melting point of the alloy. If its amount is 7.0 wt % or less, the melting point is not lowered satisfactorily whereas if its amount is over 12.0 wt %, the melting point is elevated contrarily and therefore the brazing properties are deteriorated. In particular, taking the brazing flow property into account, the amount of Si to be added is desirably 8.0 to 11.0 wt %.

Fe functions to make the crystals fine to make high the strength of the fillet of the brazed joint when the brazing alloy is melted and is then allowed to solidify and if its amount is 0.05 wt % or less, the effect is not satisfactorily exhibited. When the brazing alloy is solidified, Fe forms intermetallic compounds, which act as starting points of corrosion. Accordingly, in view of the balance between the effect of making the crystals fine and the corrosiveness, the upper limit of the amount of Fe is 0.5 wt % and the amount of Fe is preferably 0.2 wt % or less in view of the corrosiveness.

Cu lowers the melting point of the alloy to improve the brazing alloy flow property. Further Cu serves to increase the outer corrosion resistance of the filler material. Since the brazed parts of the oil cooler come in direct contact with a refrigerant, the outer corrosion resistance is required. Here, in view of the corrosion resistance, if the amount of Cu is 0.4 wt % or less, its effect is not satisfactory. To secure stable brazing properties, the amount of Cu to be added is over 1.0 wt %. If the amount of Cu is over 8.0 wt %, since the electric potential of the brazing alloy becomes noble to make members constituting refrigerant passages preferentially corroded, that is, to make the corrosion resistance lowered and the workability in rolling of the alloy is lowered, the brazing alloy will not be suitable as a filler material used for brazing sheets for the heat exchanger. Therefore, when the amount of Cu is over 1.0 wt % but 8.0 wt %, preferably 4.0 wt % or less to take the workability in rolling into account, and particularly from 1.0 to 3.5 wt %, stable properties are exhibited.

The addition of Zn lowers the melting point of the alloy to stabilize the brazing properties. Further, a conventional brazing alloy wherein Cu is added as in the present invention had the problem that the electric potential of the brazing alloy becomes nobler than that of the core and the outer corrosion occurs in a pitted pattern and at a high speed. The addition of Zn in this invention lowers the electric potential of the brazing alloy to bring the electric potential of the brazing alloy near to the electric potential of the core alloy to improve the corrosion resistance. However, if its amount is 0.5 wt % or less, its effect is not satisfactory whereas if its amount is over 10.0 wt %, since the corrosion resistance of the brazing alloy itself is lowered and the workability in rolling of the alloy is lowered, the brazing alloy is not suitable as a filler material to be used for brazing sheets for the heat exchanger. Although the above range is within the present invention, taking the brazing alloy flow properties into account, in the present alloy, the amount of Zn to be added is desirably over 2.0 wt %, and taking the workability in rolling into account, the amount of Zn to be added is desirably 6.0 wt % or less, preferably 5.0 wt % or less.

In and Sn make the electric potential of the filler material base to improve the corrosion resistance of the members constituting refrigerant passages. In and Sn are added to assist the effect of Zn. If its amount is 0.002 wt % or less, its effect is not satisfactory whereas if its amount is over 0.3 wt %, the workability in rolling of the alloy is lowered.

As inevitable impurities, other elements may be contained if the amounts are 0.30 wt % or less respectively, and the amounts are desirably 0.05 wt % or less respectively. Herein typical inevitable impurities include Ni, Cr, Zr, Ti, Mg, etc. which are often added into brazing sheets.

In the present invention, the filler materials of the brazing sheets used in the heat exchangers in the embodiments (1) and (2) stated above (the first and second filler materials, respectively) may be changed to the following filler materials (hereinafter referred to as third to sixth filler materials, respectively). The first and second filler materials can be used at a brazing temperature of higher than 570° C., but 585° C. or lower.

The filler materials are described below in detail.

A third filler material which can be used for a heat exchanger of the present invention made of an aluminum alloy is an Al alloy filler material containing Si in an amount from more than 7.0 wt % to 12.0 wt %, Cu in an amount from more than 0.4 wt % to 8.0 wt %, Fe in an amount from more than 0.05 wt % to 0.5 wt %, one kind or two or more kind elements selected from a group consisting of Zn in an amount from more than 0.5 wt % to 6.0 wt %, In in an amount of 0.3 wt % or less (preferably from 0.01 to 0.3 wt %), and Sn in an amount of 0.3 wt % or less (preferably from 0.01 to 0.3 wt %); and one kind or two or more kind elements selected from a group consisting of Li in an amount of 1.0 wt % or less (preferably from 0.1 to 0.5 wt %), Na in an amount of 0.2 wt % or less (preferably from 0.003 to 0.1 wt %), K in an amount of 0.2 wt % or less (preferably from 0.003 to 0.1 wt %), Ca in an amount of 0.2 wt % or less (preferably from 0.003 to 0.1 wt %), Sr in an amount of 0.2 wt % or less (preferably from 0.003 to 0.1 wt %), Ba in an amount of 0.2 wt % or less (preferably from 0.003 to 0.1 wt %), Bi in an amount of 0.5 wt % or less (preferably from 0.1 to 0.3 wt %), Be in an amount of 0.2 wt % or less (preferably from 0.003 to 0.1 wt %), Ni in an amount of 0.6 wt % or less (preferably from 0.05 to 0.3 wt %), Cr in an amount of 0.2 wt % or less (preferably from 0.003 to 0.1 wt %), Ti in an amount of 0.2 wt % or less (preferably from 0.003 to 0.1 wt %), Zr in an amount of 0.2 wt % or less (preferably from 0.003 to 0.1 wt %), V in an amount of 0.2 wt % or less (preferably from 0.003 to 0.1 wt %), Ga in an amount of 1.0 wt % or less (preferably from 0.3 to 0.9 wt %), and Ge in an amount of 2.0 wt % or less (preferably from 0.2 to 1.9 wt %);

the balance being Al and inevitable impurities. A fourth filler material for a heat exchanger made of an aluminum alloy of the present invention is an Al alloy filler material containing, in addition to the composition of the above third filler material, Mn in an amount from more than 0.05 wt % to 1.2 wt %.

A fifth filler material for a heat exchanger made of an aluminum alloy in the present invention is an Al alloy filler material containing Si in an amount from more than 7.0 wt % to 12.0 wt %, Cu in an amount from more than 0.4 wt % to 8.0 wt %, Fe in an amount from more than 0.05 wt % to 0.5 wt %, one kind or two kind elements selected from a group consisting of Ga in an amount of 1.0 wt % or less, and Ge in an amount of 2.0 wt % or less; and one kind or two or more kind elements selected from a group consisting of Li, Na, K, Ca, Sr, Ba, Bi, Be, Ni, Cr, Ti, Zr and V, in an amount of Li 1.0 wt % or less, Bi 0.5 wt % or less, Ni 0.6 wt % or less, and Na, K, Ca, Sr, Ba, Be, Cr, Ti, Zr or V 0.2 wt % or less; the balance being Al and inevitable impurities.

Further, a sixth filler material for a heat exchanger made of an aluminum alloy of the present invention is an Al alloy filler material containing, in addition to the composition of the above fifth filler material, Mn in an amount from more than 0.05 wt % to 1.2 wt %.

Preferable amounts to be added respectively for Ga, Ge, Li, Na, K, Ca, Sr, Ba, Bi, Be, Ni, Cr, Ti, Zr, and V in the fourth to sixth filler materials are same as those previously mentioned in the third filler material.

The technical significance and function of components in the composition of the third to sixth filler materials are described below in detail. The components that are common with the first and second filler materials have the same technical significance and function.

The addition of Ga and/or Ge is effective to make base the potential of the filler material and hence to improve the corrosion resistance of a refrigerant passage component by such a sacrifice anode effect. The addition of Ga and/or Ge also functions to reduce the potential of the filler material containing Cu to a value close to the potential of a core alloy, and hence to improve the corrosion resistance. Ga and/or Ge can be added to assist the additional effect of Zn, In and/or Sn, or in place of them. When the amount of Ga is more than 1.0 wt % or the amount of Ge is more than 2.0 wt %, the self-corrosion resistance of the filler material is reduced, which may degrade the workability in rolling of the alloy.

Li, Na, K, Ca, Ba, Sr, Be, and Bi are effective to improve the flowability, that is, the brazing properties of the Al alloy filler material by forming a brittle oxide or a low melting point compound on the surface of the filler material to facilitate the breakage of the oxide film. When the amount of Li is more than 1.0 wt %, that of Bi is more than 0.5 wt %, or that of Na, K, Ca, Sr, Ba and Be is more than 0.2 wt % respectively, the workability in rolling of the alloy may be degraded.

Mn, Ni, Cr, Ti, Zr, and V function to form an intermetallic compound upon solidification of the filler material after being melted and hence to increase the strength of a brazing portion. When the amount of Mn is 0.05 wt % or less, the additional effect may be insufficient, while when the amount of Mn is more than 1.2 wt %, that of Ni is more than 0.6 wt %, or that of Cr, Ti, Zr and V is more than 0.2 wt % respectively, the workability in rolling of the Al alloy may be degraded.

Similarly to the first and second filler materials, the third to sixth filler materials for a heat exchanger made of an aluminum alloy in the present invention can also be used at a brazing temperature higher than 570° C. but to 585° C. These filler materials are suitable for assembling a radiator and oil cooler integrated type heat exchanger.

The above is the reason of the restriction on the components of the brazing alloy of the brazing sheets of the oil cooler used in the present invention whereas there is no particular restriction on the alloy of the core material. It is recommended to use an aluminum alloy generally used for brazing sheets. However, to improve the corrosion resistance, preferably the amounts of Zn and Cu in the filler material are adjusted to bring the potential (natural potential)

difference between the filler material and the core material to 100 mV or less. If required, the brazing sheet may be a sacrificial-material-coated brazing sheet having a three-layer structure. A clad ratio of the filler material in the brazing sheets is not particularly different from that in the usual material, and there is no restriction on the amount of clad. It is recommended that a filler material is clad in an amount sufficient to brazing-joint.

The aluminum alloy of the radiator and the tank in the heat exchanger made of an aluminum alloy of the present invention is not particularly restricted. Any of generally used aluminum alloys and aluminum alloy brazing sheets as well as brazing sheets wherein the filler material used for the oil cooler of the present invention is used can be used.

Herein, the brazing conditions employed in the present invention may be usual conditions under which the radiator can be brazed without any problems. That is, there is no particular restriction and, for example, the flux brazing method and the non-corrosive flux brazing wherein a non-corrosive flux is used can be used. For example, assembling, cleaning, and, if required, applying a flux before the brazing may be carried out in a usual manner.

Figure 2:
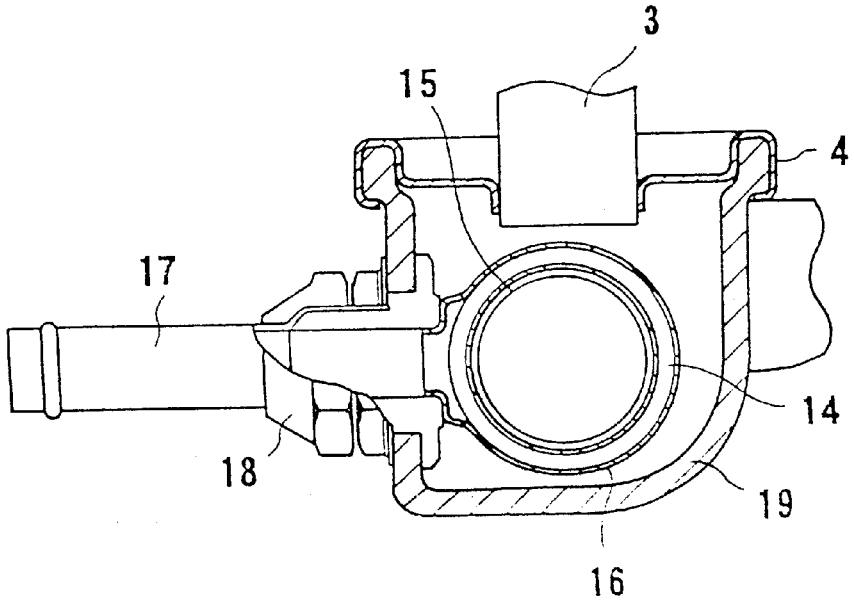
FIG. 2 is an illustrative view of an oil cooler part of another embodiment of the heat exchanger of the present invention made of an aluminum alloy.
Figure 3:
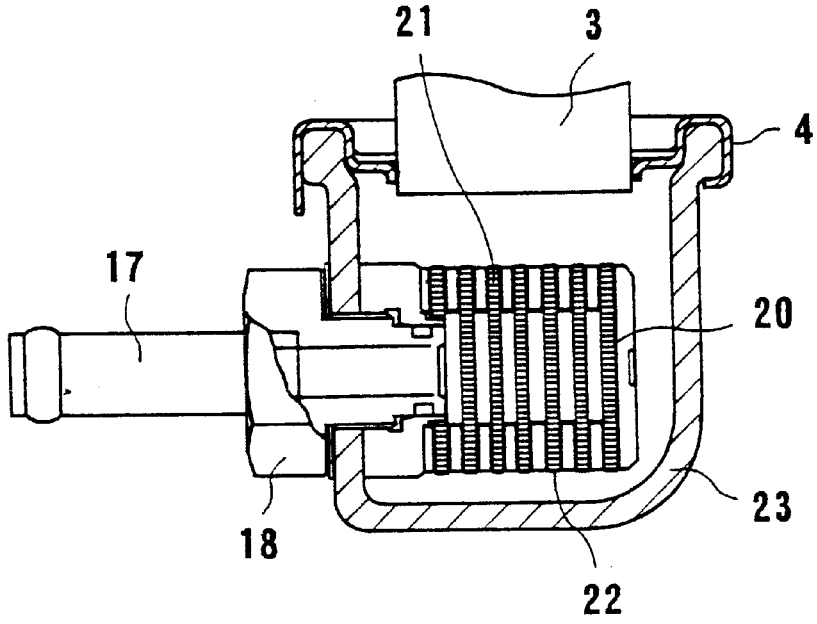
FIG. 3 is an illustrative view of an oil cooler part of still another embodiment of the heat exchanger of the present invention made of an aluminum alloy.

In the present invention, so long as the radiator and the oil cooler are integrated, there is no particular restriction on the type of the heat exchanger made of an aluminum alloy and various types can be formed. Examples of the heat exchanger are illustrated in FIGS. 2 and 3. The oil cooler part shown in FIG. 2 is of a double pipe type having an inner pipe and an outer pipe. In FIG. 2, the radiator core part is omitted since it may be basically the same as that in FIG. 1. In FIG. 2, (14) indicates a tubular oil cooler, which comprises an inner pipe (15) and an outer pipe (16). (19) indicates an aluminum alloy tank. The same reference numerals as those in FIG. 1 are used to indicate the corresponding same parts. (17) indicates a pipe and (18) indicates a connector. As shown in FIG. 2, the aluminum alloy tank (19) is made of brazing sheets and is brazed integrally to a header plate (4). Herein, the inside of the outer pipe (16) is made of the filler material having the specified composition according to the present invention. FIG. 3 shows another embodiment of the oil cooler part that is of a multi-plate type. In FIG. 3, (20) indicates an oil cooler, (21) indicates inner fins, (22) indicates a tube plate, and (23) indicates an aluminum alloy tank made of brazing sheets, the same reference numerals as those in FIG. 2 being used to indicate the corresponding same parts. In FIG. 3, the inside of the tube plate (22) is made of a brazing sheet clad with the specified filler material according to the present invention. In FIG. 3, the tank (23) is brazed integrally to the header plate (4).

EXAMPLE

The present invention is specifically described with reference to the following examples, but the present invention is not restricted to the following examples.

EXAMPLE 1

First, the following shows an example for the first and second filler material.

A heat exchanger wherein a radiator and an oil cooler were integrally formed as shown in FIG. 1 and the tank material was aluminum alloy brazing sheets was produced under heating conditions of 600° C.×5 min. Any packings were not used. The materials of the radiator are shown in Table 1. The tubes of the radiator were tubes electroseamed by using the tube material shown in Table 1. As the material for the oil cooler, brazing sheets having the following constitution were used. In their constitution, the brazing sheets were made by press molding O-material plates having a thickness of 0.6 mm, wherein the core material was an Al-0.5 wt % Si-0.3 wt % Fe-0.5 wt % Cu-1.1 wt % Mn alloy, the sacrificial material outside the core material of an Al-2 wt % Zn alloy was clad thereon, and the brazing alloy inside the core material shown in Table 2, was clad thereon in amounts of 10% for the total thickness respectively.

The oil cooler part was cut from the obtained heat exchanger and the leakage test and the corrosion test were performed.

TABLE 1

| Member | Constitution | Plate thickness | Refining |
|---|---|---|---|
| Tube material (three layers) | filler material: [4045 alloy] (10%) core material: Al-0.5 wt % Si-0.3 wt % Fe-0.5 wt % Cu-1.1 wt % Mn lining material: Al-1.5 wt % Zn (15%) | 0.25 mm | H-14-material |
| Fin material (bear) | Al-0.2 wt % Si-0.2 wt % Fe-0.1 wt % Cu-1 wt % Mn-1 wt % Zn | 0.07 mm | H-14-material |
| Header material (two layers) | filler material: [4045 alloy] (7%) core material: 3003 alloy | 1.5 mm | O-material |
| Side support material (two layers) | filler material: [4045 alloy] (7%) core material: 3003 alloy | 1.5 mm | O-material |
| Tank material (two layers) | filler material: [4045 alloy] (7%) core material: 3003 alloy | 1.5 mm | O-material |

TABLE 2

| | No. | Si | Fe | Cu | Zn | In | Sn | Al |
|---|---|---|---|---|---|---|---|---|
| Example of the present invention | A1 | 10.2 | 0.08 | 2.5 | 3.9 | — | — | balance |
| | B1 | 9.2 | 0.12 | 0.7 | 1.1 | — | — | balance |
| | C1 | 9.9 | 0.09 | 1.6 | 2.2 | — | — | balance |
| | D1 | 10.1 | 0.10 | 3.8 | 4.3 | — | — | balance |
| | E1 | 8.5 | 0.09 | 2.6 | 2.5 | 0.02 | — | balance |
| | F1 | 10.5 | 0.28 | 2.4 | 4.6 | — | 0.02 | balance |
| Comparative Example | G1 | 10.0 | 0.07 | — | 3.0 | — | — | balance |
| | H1 | 5.6 | 0.15 | 1.5 | 3.4 | — | — | balance |
| | I1 | 9.9 | 0.08 | 2.6 | 0.2 | — | — | balance |
| Conventional Example | J1 | 8.5 | 0.41 | — | — | — | — | balance |
| | K1 | 10.1 | 0.42 | — | — | — | — | balance |

(wt %)

The corrosion test was performed in such a way that from the oil cooler a part that had no leakage defect was cut out, the end of the part was masked, the part was immersed for 5 months in a tap water to which $Cu^{2+}$ ions had been added to give a concentration 10 ppm, and cycles of 80° C.×8 hours and room temperature×16 hours were repeated. The state of formation of corrosion around the brazed section was examined in cross section.

The results are shown in Table 3.

TABLE 3

| | No. | Leakage test result of the oil cooler | Result of the corrosion test |
|---|---|---|---|
| Example of the present invention | A1 | No leakage defect | No through-hole corrosion |
| | B1 | No leakage defect | No through-hole corrosion |
| | C1 | No leakage defect | No through-hole corrosion |
| | D1 | No leakage defect | No through-hole corrosion |
| | E1 | No leakage defect | No through-hole corrosion |
| | F1 | No leakage defect | No through-hole corrosion |
| Comparative Example | G1 | No leakage defect | Through-hole corrosion occurred |
| | H1 | Leakage defects occurred | No through-hole corrosion |
| | I1 | No leakage defect | Through-hole corrosion occurred |
| Conventional Example | J1 | Leakage defects occurred | Through-hole corrosion occurred |
| | K1 | Leakage defects occurred | Through-hole corrosion occurred |

Since the oil cooler part was covered with the heater tank in Examples A1 to F1, the temperature reached at brazing was lower than 600° C., that was 570 to 585° C., the brazing of the oil cooler was good and no leakage defect occurred because of the use of the filler material for low-temperature at this part. Further, the potential difference between the brazing alloy and the core material alloy in any of these Examples was within 100 mV. As a result, through-hole corrosion did not occur in the corrosion test.

In contrast, in Comparative Example H1, wherein the amount of Si was smaller than that of the present invention, and in the prior art Examples J1 and K1, wherein Cu and Zn were not contained, the oil coolers were brazed incompletely, and leakaging parts were recognized in the leakage test.

Further, in Comparative Examples G1 and I1 and the prior art Examples J1 and K1, wherein Cu and Zn were outside the present invention, the potential difference between the brazing alloy and the core material was over 100 mV. As a result, through-hole corrosions occurred in the corrosion test.

EXAMPLE 2

The following shows an example for the third to sixth filler materials.

Each of brazing metals having compositions shown in Tables 4 and 5 was clad on one surface of a core material (Al-0.27 wt % Si-0.42 wt % Fe-1.1 wt % Mn-0.52 wt % Cu alloy), to prepare brazing sheets having the thickness of 0.50 mm. The brazing sheets were subjected to thermal refining under the specification of JIS grade H14 and the clad ratio of the filler material was 10%.

TABLE 4

| | | Composition of the aluminum alloy filler material (wt %) | | | | | | | | | | |
|---|---|---|---|---|---|---|---|---|---|---|---|---|
| | No. | Si | Cu | Fe | Zn | In | Sn | Ga | Ge | Mn | | Al |
| Example of the present invention | A2 | 10.4 | 2.25 | 0.19 | 4.05 | — | — | — | — | — | Li 0.19 | balance |
| | B2 | 10.4 | 2.25 | 0.19 | 4.05 | — | — | — | — | — | Li 0.47 | balance |
| | C2 | 10.4 | 2.25 | 0.19 | 4.05 | — | — | — | — | — | Li 0.83 | balance |
| | D2 | 10.4 | 2.25 | 0.19 | 4.05 | 0.21 | — | — | — | — | Na 0.05 | balance |
| | E2 | 10.4 | 2.25 | 0.19 | 4.05 | — | 0.18 | — | — | — | K 0.04 | balance |
| | F2 | 10.4 | 2.25 | 0.19 | 4.05 | — | — | 0.87 | — | — | Ca 0.05 | balance |
| | G2 | 10.4 | 2.25 | 0.19 | 4.05 | — | — | — | 0.65 | — | Sr 0.03 | balance |
| | H2 | 10.4 | 2.25 | 0.19 | — | 0.15 | — | 0.70 | 1.52 | — | Ba 0.04 | balance |
| | I2 | 10.4 | 2.25 | 0.19 | 4.05 | — | — | — | — | — | Bi 0.09 | balance |
| | J2 | 10.4 | 2.25 | 0.19 | 2.04 | 0.04 | 0.03 | — | — | — | Bi 0.21 | balance |
| | K2 | 10.4 | 2.25 | 0.19 | 4.05 | — | — | — | 0.24 | — | Be 0.09 | balance |
| | L2 | 10.4 | 2.25 | 0.19 | 2.04 | — | — | 0.49 | — | — | Ni 0.10 | balance |
| | M2 | 10.4 | 2.25 | 0.19 | 1.45 | — | — | 0.75 | — | — | Cr 0.04 | balance |
| | N2 | 10.4 | 2.25 | 0.19 | 2.04 | — | — | — | 0.31 | — | Ti 0.08 | balance |

TABLE 5

| | | Composition of the aluminum alloy filler material (wt %) | | | | | | | | | | |
|---|---|---|---|---|---|---|---|---|---|---|---|---|
| | No. | Si | Cu | Fe | Zn | In | Sn | Ga | Ge | Mn | | Al |
| Example of the present invention | O2 | 10.4 | 2.25 | 0.19 | 2.04 | — | — | — | 0.66 | — | Zr 0.05 | balance |
| | P2 | 10.4 | 2.25 | 0.19 | 1.67 | — | — | — | 1.52 | — | V 0.09 | balance |
| | Q2 | 10.4 | 2.25 | 0.19 | — | — | — | 0.87 | — | — | Li 0.22 | balance |
| | R2 | 10.4 | 2.25 | 0.19 | — | — | — | — | 0.66 | — | Ca 0.15 | balance |
| | S2 | 10.4 | 2.25 | 0.19 | 4.05 | — | — | — | — | 0.30 | Li 0.53 | balance |
| | T2 | 10.4 | 2.25 | 0.19 | 4.05 | — | — | — | — | 0.61 | Sr 0.19 | balance |
| | U2 | 10.4 | 2.25 | 0.19 | — | — | — | 0.81 | — | 0.30 | Li 0.72 | balance |
| | V2 | 10.4 | 2.25 | 0.19 | — | — | — | — | 1.85 | 0.81 | Be 0.17 | balance |
| Comparative Example | a | 5.3 | 0.91 | 0.28 | 2.30 | | | | | | | balance |
| | b | 10.4 | — | 0.19 | 4.30 | | | | | | | balance |

Each of the above brazing sheets was subjected to the following brazing test by heating at a brazing temperature shown in Tables 6 and 7.

The brazing sheet was taken as a lower sheet and a sheet (thickness: 0.5 mm) of an Al-1.2 wt % Si-0.25 wt % Fe-0.4 wt % Cu-1.1 wt % Mn alloy-H14 material was taken as an upper sheet. The lower sheet was assembled with the upper sheet in the form of a T joint. A brazing portion of the T joint was coated with a liquid containing a potassium fluoride series flux at a concentration of 10% and heated in a $N_2$ gas to be thus brazed. In this brazing test, 50 pieces of T joints were prepared for each brazing sheet. The number of occurrence of incomplete brazing of the T joints was estimated by visual inspection. Complete brazed T joints were then subjected to tensile test to check the breaking point of each T joint for examining the strength of each brazing portion.

The results are shown in Tables 6 and 7.

TABLE 6

| | No. | Brazing temperature (° C.) | Characters after brazing: Brazing property* Number of occurence of incomplete brazing of T joints | Characters after brazing: Fillet strength** Braking points of T joints | |
|---|---|---|---|---|---|
| Example of the present invention | A2 | 575 | absence | brazing portion | X |
| | B2 | 575 | absence | brazing portion | X |
| | C2 | 575 | absence | brazing portion | X |
| | D2 | 575 | absence | brazing portion | X |
| | E2 | 575 | absence | brazing portion | X |
| | F2 | 575 | absence | brazing portion | X |
| | G2 | 575 | absence | brazing portion | X |
| | H2 | 575 | absence | brazing portion | X |
| | I2 | 575 | absence | brazing portion | X |
| | J2 | 575 | absence | brazing portion | X |
| | K2 | 575 | absence | brazing portion | X |
| | L2 | 575 | 5 | base material | O |
| | M2 | 575 | 2 | base material | O |
| | N2 | 575 | 3 | base material | O |

(Note) *Criteria for evaluation of brazing property
Qualified: Number of occurence of incomplete brazing T joints ≦ 6
Disqualified: Number of occurence of incomplete brazing T joints > 6
**Fillet strength
O: base material of T joints broken
X: brazing portion of T joints broken

TABLE 7

| | No. | Brazing temperature (° C.) | Characters after brazing: Brazing property* Number of occurence of incomplete brazing of T joints | Characters after brazing: Fillet strength** Braking points of T Joints | |
|---|---|---|---|---|---|
| Example of the present invention | O2 | 575 | 6 | base material | O |
| | P2 | 575 | 4 | base material | O |
| | Q2 | 575 | absence | brazing portion | X |
| | R2 | 575 | absence | brazing portion | X |
| | S2 | 575 | absence | brazing portion | X |
| | T2 | 575 | absence | brazing portion | X |
| | U2 | 575 | absence | brazing portion | X |
| | V2 | 575 | absence | brazing portion | X |
| Comparative Example | a | 575 | 50 | Brazing could not be done so that the tests could not be done. | |

TABLE 7-continued

| | No. | Brazing temperature (° C.) | Characters after brazing: Brazing property* Number of occurence of incomplete brazing of T joints | Characters after brazing: Fillet strength** Braking points of T Joints |
|---|---|---|---|---|
| | b | 575 | 50 | Brazing could not be done so that the tests could not be done. |

(Note) *Criteria for evaluation of brazing property
Qualified: Number of occurence of incomplete brazing T joints ≦ 6
Disqualified: Number of occurence of incomplete brazing T joints > 6
**Fillet strength
O: base material of T joints broken
X: brazing portion of T joints broken As is apparent from the results shown in Tables 6 and 7, the examples A2 to V2 for the present invention exhibit good brazing property even at 575° C. that is a temperature lower than the conventional method. Therefore, with the filler material in the present invention, it is possible to satisfactorily assemble a radiator and oil cooler integrated type heat exchanger made of an aluminum alloy, without causing brazing defects even when the temperature of brazing is not elevated so high due to the tank that covers the oil cooler part.

INDUSTRIAL APPLICABILITY

Since the heat exchanger produced in accordance with the present invention does not use a resin tank, the heat exchanger is characterized in that it is readily recycled, the corrosion resistance is excellent, and a step of caulking the tank is not required to produce the heat exchanger.

Having described our invention as related to the present embodiments, it is our intention that the invention not be limited by any of the details of the description, unless otherwise specified, but rather be construed broadly within its spirit and scope as set out in the accompanying claims.

What is claimed is:

1. A heat exchanger made of a first aluminum alloy having a radiator part and an oil cooler part in combination and manufactured integrally by a brazing method, wherein a refrigerant tank for covering and sealing said oil cooler part is made of said first aluminum alloy, wherein said oil cooler part comprises brazing sheets, said oil cooler part and said brazing sheets are clad with a filler material, and wherein said oil cooler part is brazed in said tank;

said filler material is a second aluminum alloy containing Si in an amount from more than 7.0 wt % to 12.0 wt %, Cu in an amount from more than 0.4 wt % to 8.0 wt %, Fe in an amount from more than 0.05 wt % to 0.5 wt %, one or more elements selected from a group consisting of Zn in an amount from more than 0.5 wt % to 6.0 wt %, In in an amount of 0.3 wt % or less, and Sn in an amount of 0.3 wt % or less; and one or more elements selected from a group consisting of Li in an amount of 1.0 wt % or less, Na in an amount of 0.2 wt % or less, K in an amount of 0.2 wt % or less, Ca in an amount of 0.2 wt % or less, Sr in an amount of 0.2 wt % or less, Ba in an amount of 0.2 wt % or less, Bi in an amount of 0.5 wt % or less, Be in an amount of 0.2 wt % or less, Ni in an amount of 0.6 wt % or less, Cr in an amount of 0.2 wt % or less, Ti in an amount of 0.2 wt % or less, Zr in an amount of 0.2 wt % or less, V in an amount of 0.2 wt % or less, and one or more elements selected from a group consisting of Ga in an amount of 1.0 wt % or less, and Ge in an amount of 2.0 wt % or less:

the balance being Al and inevitable impurities, and wherein said refrigerant tank is assembled integrally with said radiator part and said oil cooler part by brazing with said brazing material.

2. A heat exchanger made of a first aluminum alloy having a radiator part and an oil cooler part in combination and manufactured integrally by a brazing method, wherein a refrigerant tank for covering and sealing said oil cooler part is made of said first aluminum alloy, wherein said oil cooler part comprises brazing sheets, said oil cooler part and said brazing sheets are clad with a filler material, and wherein said oil cooler part is brazed in said tank;

said filler material is a second aluminum alloy containing Si in an amount from more than 7.0 wt % to 12.0 wt %, Cu in an amount from more than 0.4 wt % to 8.0 wt %, Fe in an amount from more than 0.05 wt % to 0.5 wt %, Mn in an amount from more than 0.05 wt % to 1.2 wt %, one or more elements selected from a group consisting of Zn in an amount from more than 0.5 wt % to 6.0 wt %, In in an amount of 0.3 wt % or less, and Sn in an amount of 0.3 wt % or less; and one or more elements selected from a group consisting of Li in an amount of 1.0 wt % or less, Na in an amount of 0.2 wt % or less, K in an amount of 0.2 wt % or less, Ca in an amount of 0.2 wt % or less, Sr in an amount of 0.2 wt % or less, Ba in an amount of 0.2 wt % or less, Bi in an amount of 0.5 wt % or less, Be in an amount of 0.2 wt % or less, Ni in an amount of 0.6 wt % or less, Cr in an amount of 0.2 wt % or less, Ti in an amount of 0.2 wt % or less, Zr in an amount of 0.2 wt % or less, V in an amount of 0.2 wt % or less, and one or more elements selected from a group consisting of Ga in an amount of 1.0 wt % or less, and Ge in an amount of 2.0 wt % or less;

the balance being Al and inevitable impurities, and wherein said refrigerant tank is assembled integrally with said radiator part and said oil cooler part by brazing with said brazing material.

3. A heat exchanger made of a first aluminum alloy having a radiator part and an oil cooler part in combination and manufactured integrally by a brazing method, wherein a refrigerant tank for covering and sealing said oil cooler part is made of said first aluminum alloy, wherein said oil cooler part comprises brazing sheets, said oil cooler part and said brazing sheets are clad with a filler material, and wherein said oil cooler part is brazed in said tank;

said filler material is a second aluminum alloy containing Si in an amount from more than 7.0 wt % to 12.0 wt %, Cu in an amount from more than 0.4 wt % to 8.0 wt %, Fe in an amount from more than 0.05 wt % to 0.5 wt %, one or two elements selected from a group consisting of Ga in an amount of 1.0 wt % or less, and Ge in an amount of 2.0 wt % or less; and one or more elements selected from a group consisting of Li in an amount of 1.0 wt % or less, Na in an amount of 0.2 wt % or less, K in an amount of 0.2 wt % or less, Ca in an amount of 0.2 wt % or less, Sr in an amount of 0.2 wt % or less, Ba in an amount of 0.2 wt % or less, Bi in an amount of 0.5 wt % or less, Be in an amount of 0.2 wt % or less, Ni in an amount of 0.6 wt % or less, Cr in an amount of 0.2 wt % or less, Ti in an amount of 0.2 wt % or less, Zr in an amount of 0.2 wt % or less, and V in an amount of 0.2 wt % or less;

the balance being Al and inevitable impurities, and wherein said refrigerant tank is assembled integrally with said radiator part and said oil cooler part by brazing with said brazing material.

4. A heat exchanger made of a first aluminum alloy having a radiator part and an oil cooler part in combination and manufactured integrally by a brazing method, wherein a refrigerant tank for covering and sealing said oil cooler part is made of said first aluminum alloy, wherein said oil cooler part comprises brazing sheets, said oil cooler part and said brazing sheets are clad with a filler material, and wherein said oil cooler part is brazed in said tank;

said filler material is a second aluminum alloy containing Si in an amount from more than 7.0 wt % to 12.0 wt %, Cu in an amount from more than 0.4 wt % to 8.0 wt %, Fe in an amount from more than 0.05 wt % to 0.5 wt %, Mn in an amount from more than 0.05 wt % to 1.2 wt %, one or two elements selected from a group consisting of Ga in an amount of 1.0 wt % or less, and Ge in an amount of 2.0 wt % or less; and one or more elements selected from a group consisting of Li in an amount of 1.0 wt % or less, Na in an amount of 0.2 wt % or less, K in an amount of 0.2 wt % or less, Ca in an amount of 0.2 wt % or less, Sr in an amount of 0.2 wt % or less, Ba in an amount of 0.2 wt % or less, Si in an amount of 0.5 wt % or less, Be in an amount of 0.2 wt % or less, Ni in an amount of 0.6 wt % or less, Cr in an amount of 0.2 wt % or less, Ti in an amount of 0.2 wt % or less, Zr in an amount of 0.2 wt % or less, and V in an amount of 0.2 wt % or less;

the balance being Al and inevitable impurities, and wherein said refrigerant tank is assembled integrally with said radiator part and said oil cooler part by brazing with said brazing material.

5. The heat exchanger according to claim 1, wherein said second aluminum alloy contains Ge.

6. The heat exchanger according to claim 2, wherein said second aluminum alloy contains Ge.

7. The heat exchanger according to claim 3, wherein said second aluminum alloy contains Ge.

8. The heat exchanger according to claim 4, wherein said second aluminum alloy contains Ge.

* * * * *